US012687354B2

(12) United States Patent
Jacobson et al.

(10) Patent No.: US 12,687,354 B2
(45) Date of Patent: Jul. 21, 2026

(54) BOLT ACTION FIREARM

(71) Applicant: Franklin Armory Holdings, Inc., Minden, NV (US)

(72) Inventors: Jay Leonard Jacobson, Minden, NV (US); Kyle Ketten, Minden, NV (US); Grant Vaughan, Minden, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 18/954,095

(22) Filed: Nov. 20, 2024

(65) Prior Publication Data

US 2025/0198713 A1 Jun. 19, 2025

Related U.S. Application Data

(60) Provisional application No. 63/611,929, filed on Dec. 19, 2023.

(51) Int. Cl.
*F41A 3/14* (2006.01)
*F41A 15/14* (2006.01)

(52) U.S. Cl.
CPC ..... *F41A 3/14* (2013.01); *F41A 15/14* (2013.01)

(58) Field of Classification Search
CPC .... F41A 3/12; F41A 3/14; F41A 15/12; F41A 15/14
USPC ..... 42/14, 25, 46
See application file for complete search history.

(56) References Cited

U.S. PATENT DOCUMENTS 476,290 A * 6/1892 Mauser ..... F41A 15/14 42/16
4,553,469 A * 11/1985 Atchisson ..... F41A 5/18 42/25
4,920,677 A * 5/1990 Schuerman ..... F41A 9/40 42/16
5,826,361 A * 10/1998 Jamison ..... F42B 5/025 42/16
9,097,478 B1 * 8/2015 Karagias ..... F41A 15/14
11,300,374 B1 * 4/2022 Tritsch ..... F41A 3/22
2015/0330731 A1 * 11/2015 Kolev ..... F41A 17/46 42/25
2017/0299300 A1 * 10/2017 Larue ..... F41A 15/14

FOREIGN PATENT DOCUMENTS

GB 2492384 A * 1/2013 ..... F41A 3/26

* cited by examiner

*Primary Examiner* — Bret Hayes
(74) *Attorney, Agent, or Firm* — Bennet K. Langlotz; Langlotz Patent & Trademark Works, LLC

(57) ABSTRACT

A bolt action firearm has an ejector element movable between a forward position in which a portion of the ejector element protrudes from the bolt face and a rearward position rear of the forward position, an ejector restraint element operable in a restraining position to restrain the ejector element to the rearward position and in a release position to enable movement of the ejector element from the rearward position to the forward position, an actuator movable between a first position and a second position such that seating a cartridge case head in an aligned position motivates the actuator from the first position to the second position, and a linkage connecting the actuator to the ejector restraint element and operable in response to movement of the actuator from the first position to the second position to enable movement of the ejector element from the rearward position to the forward position.

14 Claims, 22 Drawing Sheets

BOLT ACTION FIREARM

CROSS-REFERENCE TO RELATED APPLICATION

This application claims the benefit of U.S. Provisional Patent Application No. 63/611,929 filed on Dec. 19, 2023, entitled "INTERMITTENT FIREARM EJECTOR," which is hereby incorporated by reference in its entirety for all that is taught and disclosed therein.

FIELD OF THE INVENTION

The present invention relates to firearms, and more particularly to a bolt action firearm that incorporates an intermittent push feed ejector into a control feed bolt face.

BACKGROUND AND SUMMARY OF THE INVENTION

Manually operated firearm users need a more reliable way of both feeding and ejecting cartridges because current offerings tend to only prioritize one function or the other. Controlled round feed allows for the cartridge to be under the control of the bolt while feeding and extracting, but ejection is often dependent on how fast the user retracts the bolt. Push round feed does not allow for the bolt to have control of the cartridge while feeding, but push round feed does allow for positive ejection no matter the rate at which the bolt is retracted. An ideal manually operated firearm would have both control of the cartridge as the cartridge is being fed and positive ejection upon extraction.

Therefore, a need exists for a new and improved bolt action firearm that incorporates an intermittent push feed ejector into a control feed bolt face. In this regard, the various embodiments of the present invention substantially fulfill at least some of these needs. In this respect, the bolt action firearm according to the present invention substantially departs from the conventional concepts and designs of the prior art, and in doing so provides an apparatus primarily developed for the purpose of incorporating an intermittent push feed ejector into a control feed bolt face.

The present invention provides an improved bolt action firearm, and overcomes the above-mentioned disadvantages and drawbacks of the prior art. As such, the general purpose of the present invention, which will be described subsequently in greater detail, is to provide an improved bolt action firearm that has all the advantages of the prior art mentioned above.

To attain this, the preferred embodiment of the present invention essentially comprises a receiver defining a bolt passage, a barrel defining a chamber connected to the receiver, a bolt assembly received in the bolt passage and operable to reciprocate between a forward battery position proximate the barrel and a rearward fully open position, the bolt assembly including a bolt head having a bolt face configured to abut a cartridge case head and receive the cartridge case head in an aligned position for discharge, the bolt head defining an ejector bore having an ejector bore aperture in the bolt face, an ejector element received in the ejector bore and movable between a forward position in which a portion of the ejector element protrudes from the bolt face and a rearward position rear of the forward position, the ejector element being spring biased to the forward position, an ejector restraint element movable between a restraining position and a release position and operable in the restraining position to restrain the ejector element to the rearward position, and when in the release position to enable movement of the ejector element from the rearward position to the forward position, an actuator associated with the bolt face and movable between a first position conflicting with the presence of a cartridge case head in the aligned position, and a second position enabling a cartridge case head in the aligned position, such that seating a cartridge case head in the aligned position motivates the actuator from the first position to the second position, and a linkage connecting the actuator to the ejector restraint element and operable in response to movement of the actuator from the first position to the second position to enable movement of the ejector element from the rearward position to the forward position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
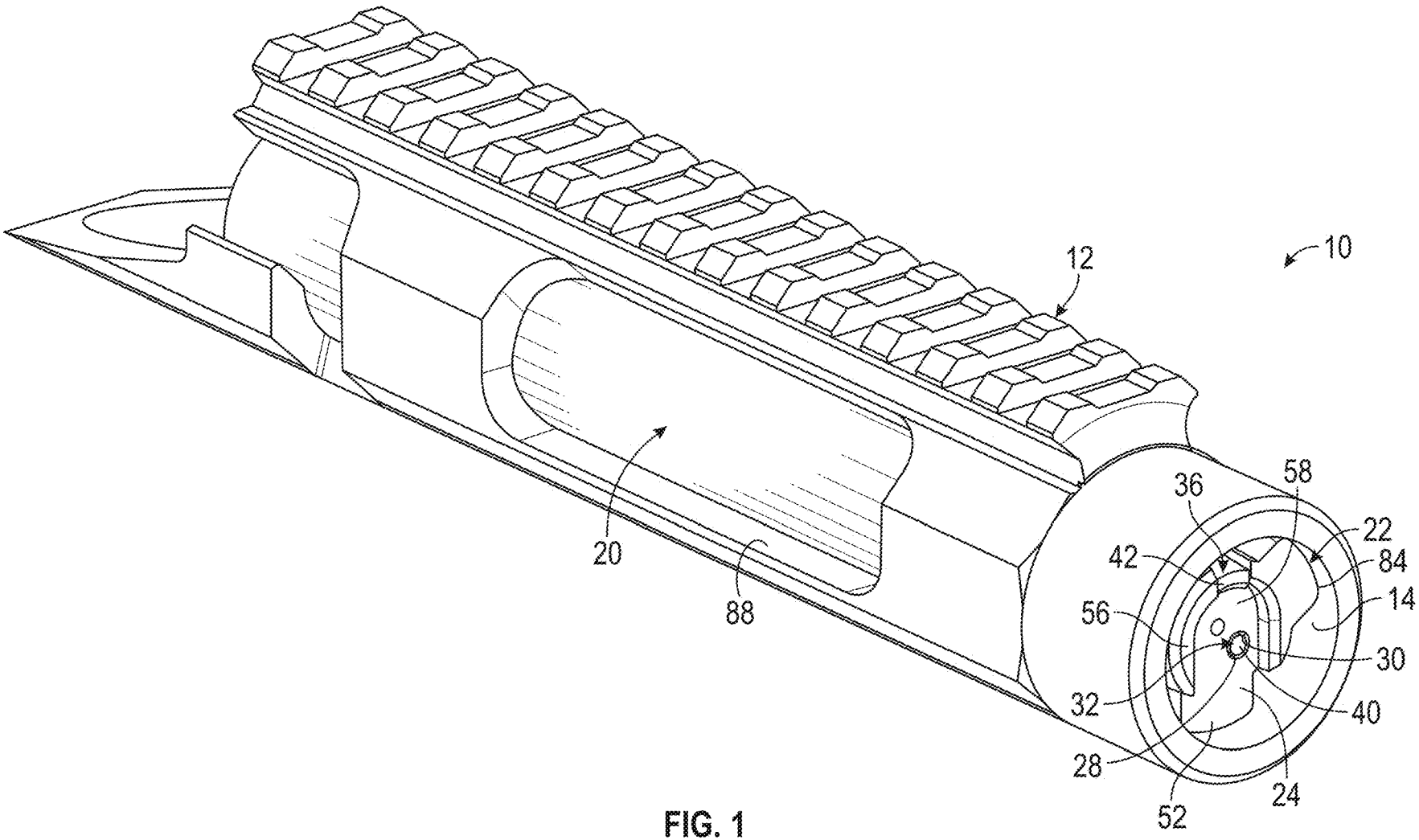
FIG. 1 is a top isometric view of the current embodiment of a bolt action firearm constructed in accordance with the principles of the present invention.
Figure 2:
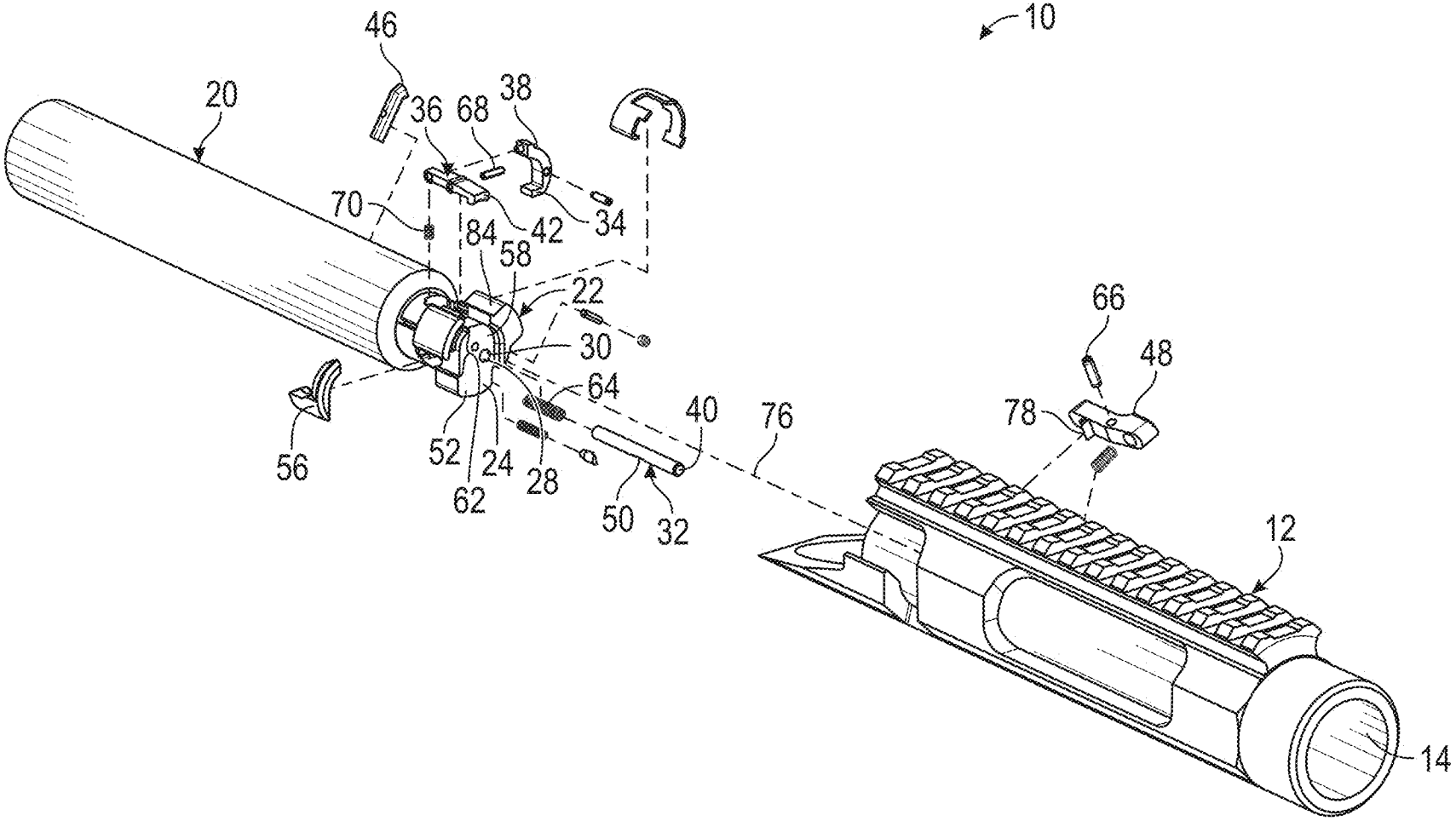
FIG. 2 is a right exploded view of the bolt action firearm of FIG. 1.
Figure 3:
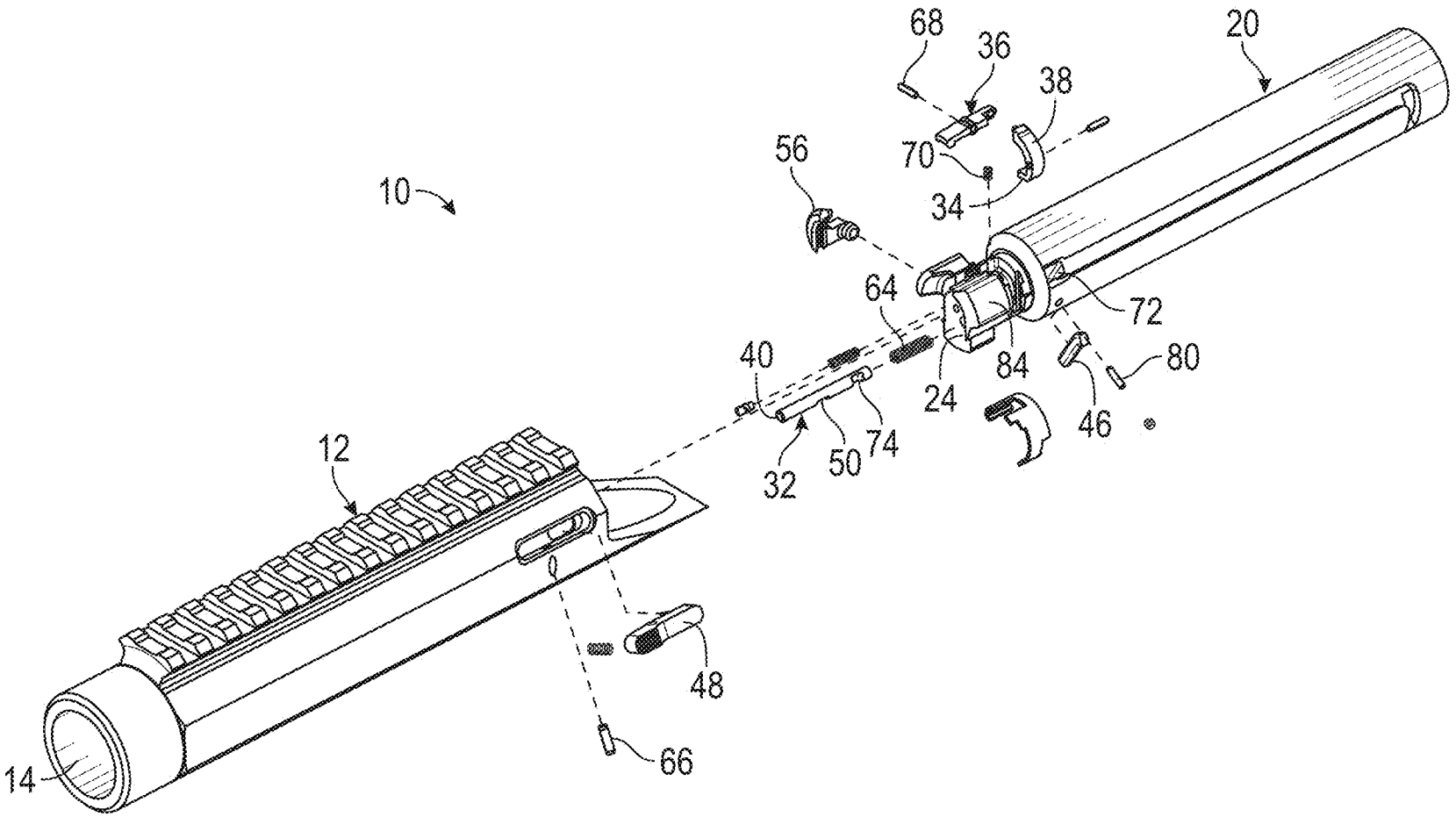
FIG. 3 is a left exploded view of the bolt action firearm of FIG. 1.

An embodiment of the bolt action firearm of the present invention is shown and generally designated by the reference numeral 10.

FIGS. 1-4 illustrate the improved bolt action firearm 10 of the present invention. More particularly, the bolt action firearm includes a receiver 12 defining a bolt passage 14. A barrel 16 defining a chamber 18 is connected to the receiver. A bolt assembly 20 is received in the bolt passage and is operable to reciprocate between a forward battery position proximate the barrel (shown in FIGS. 13 & 14) and a rearward fully open position (shown in FIGS. 20A & B). The bolt assembly includes a bolt head 22 having a bolt face 24 configured to abut a cartridge case head 26 and receive the cartridge case head in an aligned position for discharge (shown in FIGS. 13 & 14). The bolt head defines an ejector bore 28 having an ejector bore aperture 30 in the bolt face. An ejector element 32 is received in the ejector bore and is movable between a forward position in which a portion of the ejector element protrudes from the bolt face (shown in FIG. 5A) and a rearward position rear of the forward position (shown in FIG. 5B). The ejector element is spring biased to the forward position by spring 64 in the current embodiment.

An ejector restraint element 34 is movable between a restraining position and a release position. The ejector restraint element is operable in the restraining position to restrain the ejector element to the rearward position, and when in the release position to enable movement of the ejector element from the rearward position to the forward position. An actuator 36 is associated with the bolt face 24 and is movable between a first position conflicting with the presence of a cartridge case head 26 in the aligned position, and a second position enabling a cartridge case head in the aligned position, such that seating a cartridge case head in the aligned position motivates the actuator from the first position to the second position by pivoting about pin 68. A linkage 38 connects the actuator to the ejector restraint element and is operable in response to movement of the actuator from the first position to the second position to enable movement of the ejector element from the rearward position to the forward position.

In the current embodiment, the ejector element 32 does not protrude from the bolt face 24 when in the rearward position. The ejector element has a forward end face 40 when in the rearward position that is in one of a first condition flush with the bolt face and a second condition recessed with respect to the bolt face. The actuator 36 is a lever having a forward end 42 positioned forward of the bolt face. The actuator is configured for motivating contact by a case rim 44. The actuator is spring biased to the first position by a spring 70.

The bolt action firearm 10 also includes a reset element 46 operably engaging the ejector element 32 and operable in response to movement of the bolt assembly 20 to the fully open position to move the ejector element to the rearward position. The reset element is received in a channel 72 defined by the bolt assembly and engages a notch 74 defined by the ejector element. The receiver 12 includes a stop element 48 configured for contact by the reset element. The stop element is a bolt disassembly element operable to enable removal of the bolt assembly from the receiver in the current embodiment. The reset element is pivotally connected to the bolt assembly by pin 66.

Figure 4:
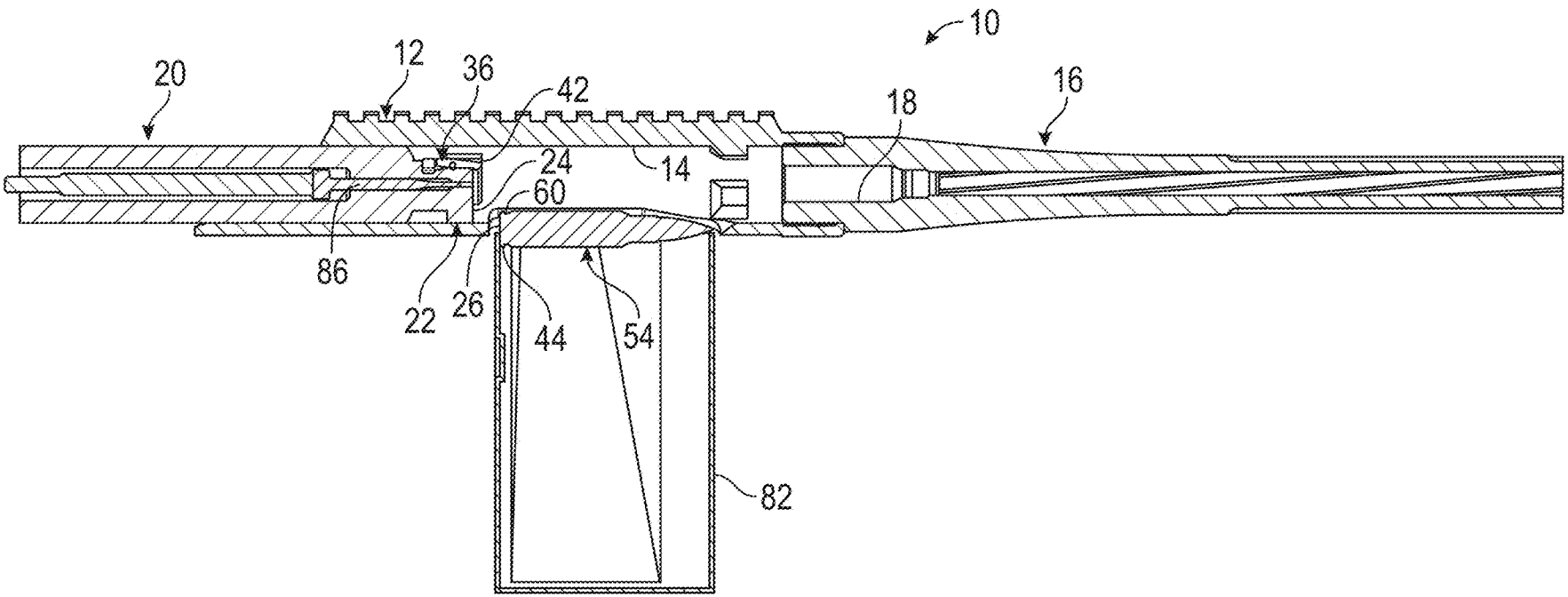
FIG. 4 is a side sectional view of the bolt action firearm of FIG. 1 ready to feed a cartridge from a magazine into the chamber of a barrel.

The ejector element 32 is an elongated body defining a notch 50 at an intermediate location along the length of the elongated body configured for contact by the ejector restraint element 34 on the linkage 38. The bolt face 24 has a lower portion 52 free of forward protrusions such that the lower portion is operable to strip a cartridge 54 and enable the cartridge case head 26 to slide upward along the bolt face to contact an extractor element 56. The bolt face has an upper portion 58 bounded by the extractor element, which is configured to engage a case rim groove 60 and to prevent the cartridge from being separated from the bolt face in a forward direction. The extractor element bounds a major portion 62 of the upper portion. FIG. 4 illustrates the bolt action firearm 10 at the start of feeding a cartridge 54 from a magazine 82.

Figure 5A:
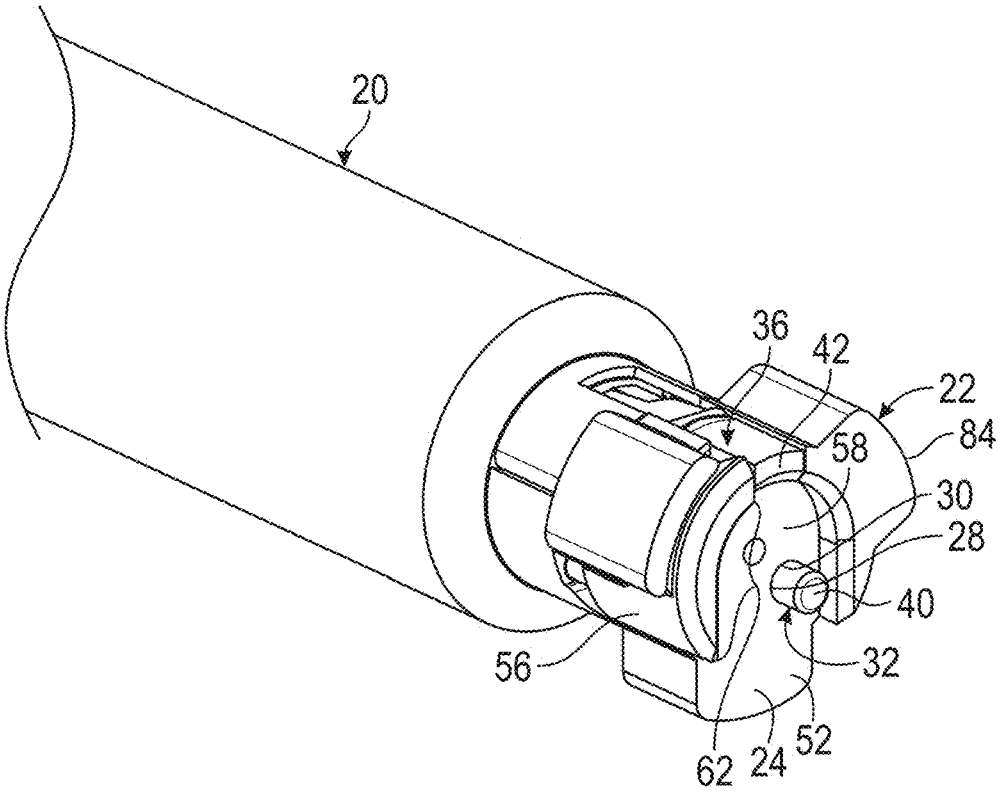
FIG. 5A is an enlarged fragmentary isometric view of the bolt assembly of FIG. 1 with the ejector element in the forward position.
Figure 5B:
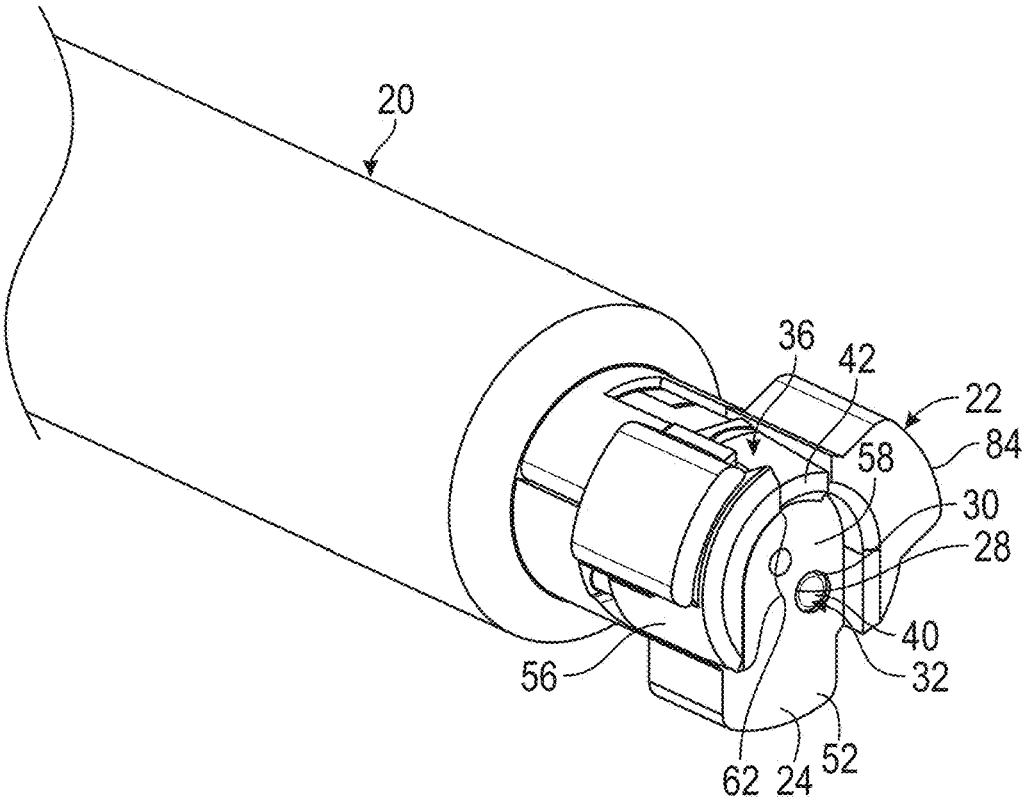
FIG. 5B is an enlarged fragmentary isometric view of the bolt assembly of FIG. 1 with the ejector element in the rearward position.
Figure 6A:
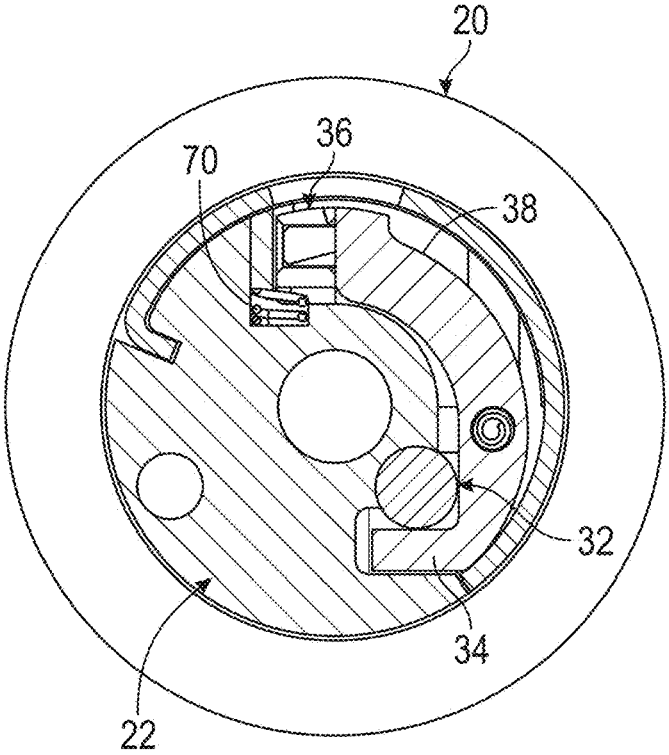
FIG. 6A is a cross-sectional view of the bolt assembly of FIG. 1 with the ejector restraint element disengaged from the notch in the ejector element so the ejector element is able to travel to the forward position.
Figure 6B:
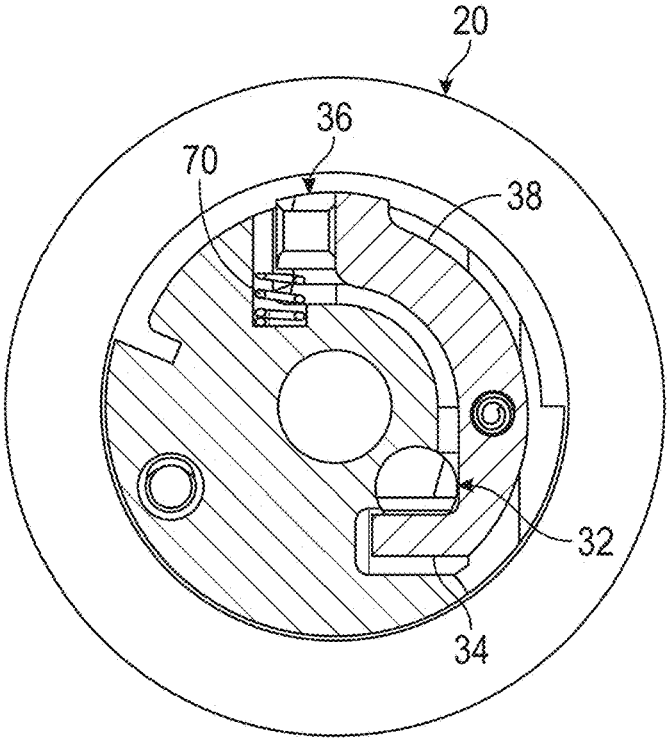
FIG. 6B is a cross-sectional view of the bolt assembly of FIG. 1 with the ejector restraint element engaged with the notch in the ejector element so the ejector element is restrained in the rearward position.
Figure 7A:
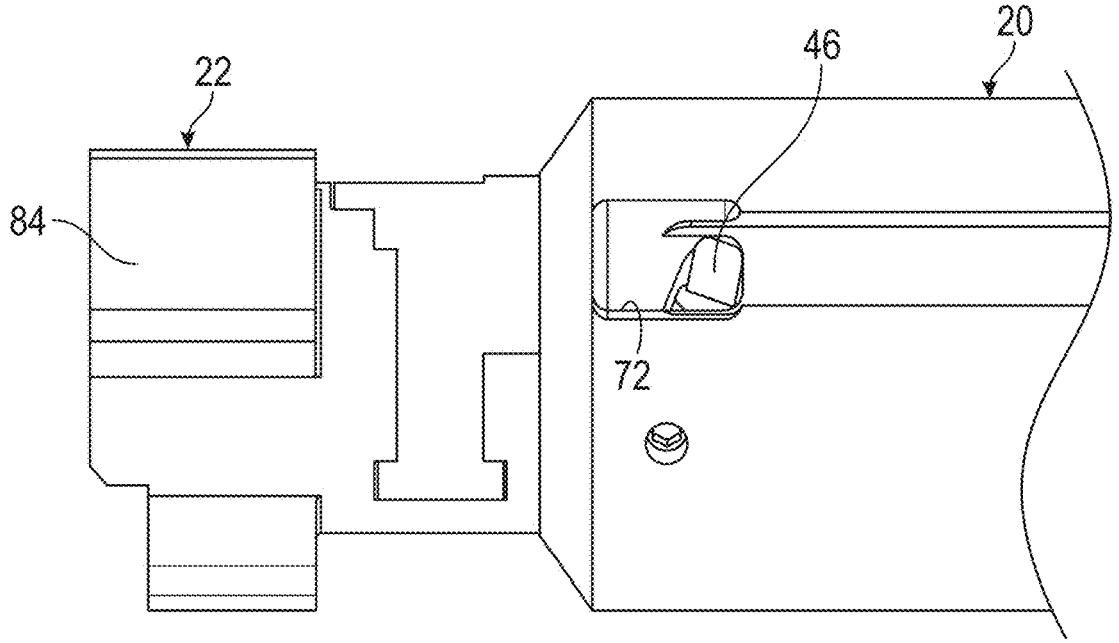
FIG. 7A is an enlarged fragmentary left side view of the bolt assembly of FIG. 1 with the top of the reset element in the rearward position.
Figure 7B:
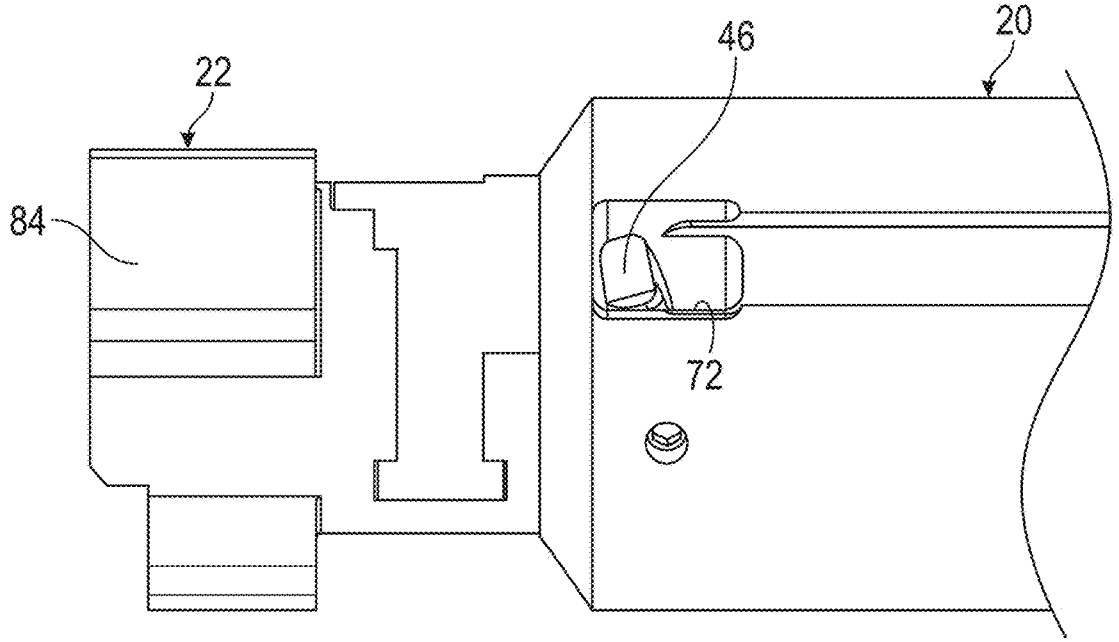
FIG. 7B is an enlarged fragmentary left side view of the bolt assembly of FIG. 1 with the top of the reset element in the forward position.
Figure 8A:
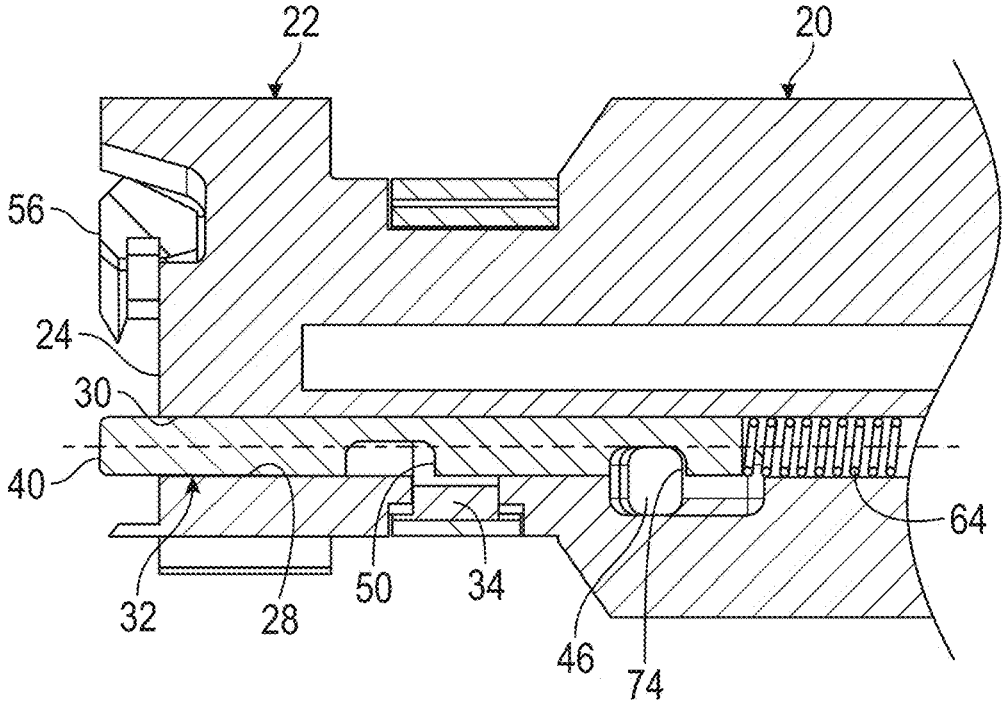
FIG. 8A is an enlarged fragmentary left side sectional view of the bolt assembly of FIG. 1 with the bottom of the reset element in the forward position.
Figure 8B:
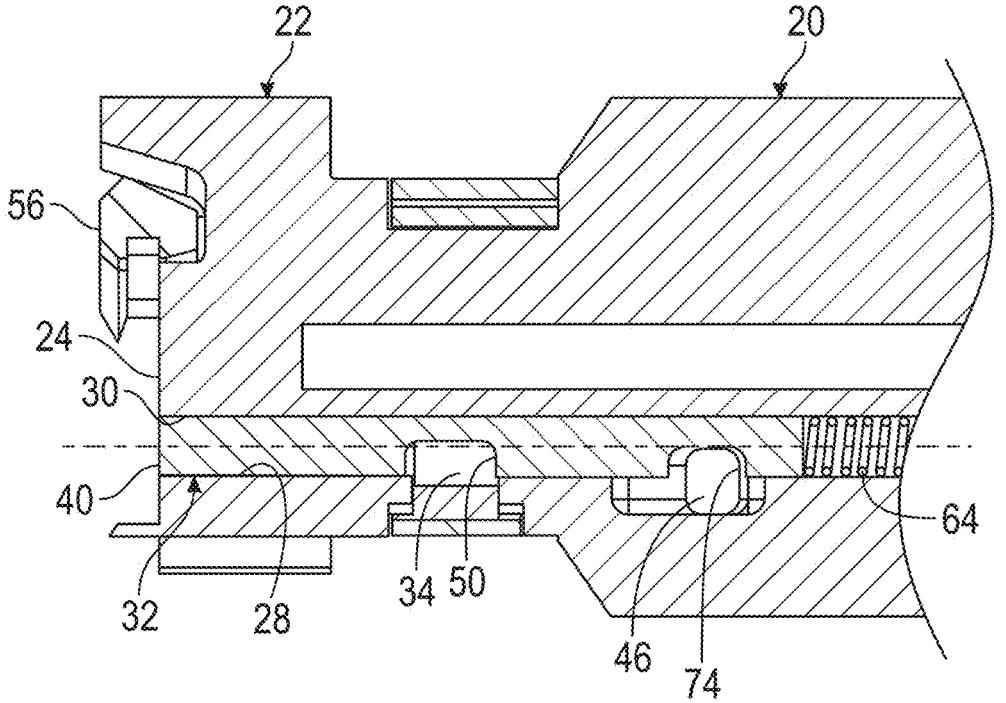
FIG. 8B is an enlarged fragmentary left side view of the bolt assembly of FIG. 1 with the bottom of the reset element in the rearward position.

FIGS. 5A-8B illustrate the improved bolt assembly 20 of the present invention. More particularly, the ejector element 32 is in the forward position in FIGS. 5A, 6A, 7A & 8A and is in the rearward position in FIGS. 5B, 6B, 7B & 8B. In FIG. 5A, the ejector element protrudes from the bolt face 24. In FIG. 5B, the ejector element is retracted either flush with or a little below the bolt face. In FIGS. 6A & 8A, the actuator 36 is in the second position because of the presence of a cartridge 54, which lowered the ejector restraint element 34 via linkage 38. This movement disengaged the ejector restraint element from the notch 50 in the ejector element, enabling the ejector element to spring forward under the influence of spring 64. In FIGS. 6B & 8B, the actuator 36 is in the first position because of spring 70 not being counteracted by the presence of a cartridge. The ejector restraint element is therefore raised by the linkage into the notch in the ejector element, keeping the ejector element in the rearward position. In FIGS. 7A & 8A with the ejector element in the forward position, the top of the reset element 46 is in the rear position. The bottom of the reset element is attached to the ejector element by notch 74 in the ejector element and is in the forward position. In FIGS. 7B & 8B with the ejector element in the rearward position, the top of the reset element is in the forward position. The bottom of the reset element is attached to the ejector element by notch 74 in the ejector element and is in the rearward position.

Figure 9A:
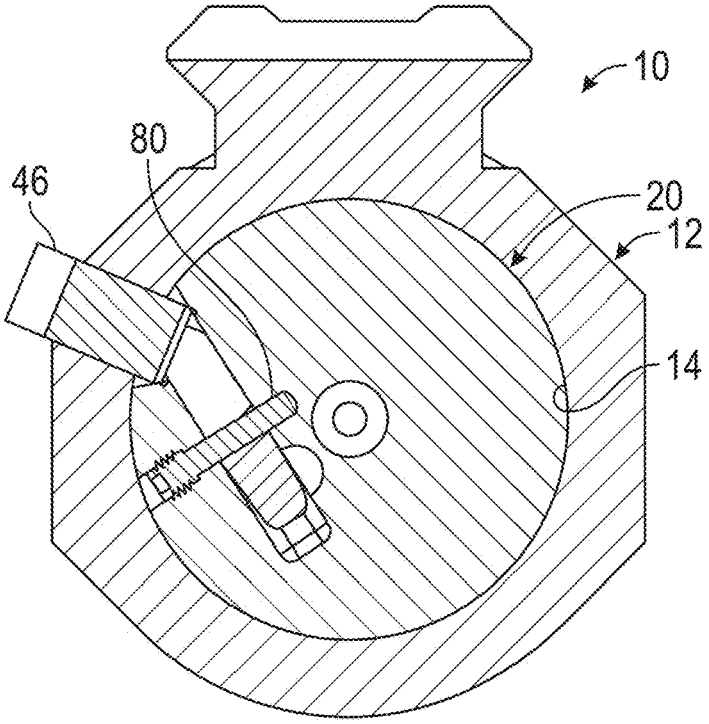
FIG. 9A is a cross-sectional view of the bolt action firearm of FIG. 1 with the bolt assembly in the fully open position.
Figure 9B:
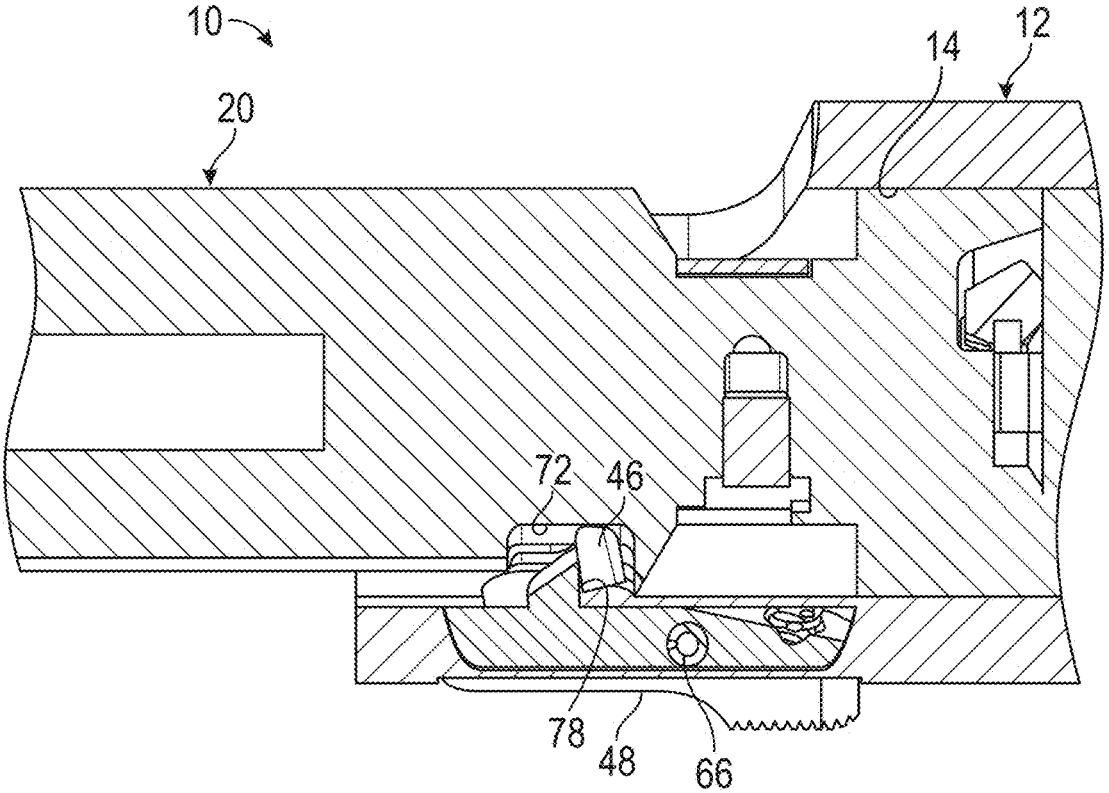
FIG. 9B is a bottom sectional view of the bolt action firearm of FIG. 1 with the bolt assembly in the fully open position.

FIGS. 9A & B illustrate the improved bolt action firearm 10 of the present invention. More particularly, FIG. 9A shows that when the bolt assembly 20 is at the rearmost travel point (the fully open position), the stop element 48 resets the ejector element 32 via the reset element 46. The stop element is pinned to the receiver 12 by pin 66 and does not move along the bolt axis 76. The pawl 78 that stops the bolt assembly hits the top of the reset element, pushing the reset element forward. The reset element rotates on its axis pin 80 and the bottom of the reset element rotates rearward. The bottom of the reset element pulls the ejector element to the rear by the notch 74 in the ejector element. The linkage 38 then slides up to catch the notch 50 in the ejector element with the ejector restraint element 34. The linkage slides up because of the spring pressure resulting from spring 70 on the bottom of the back of the actuator 36. FIG. 9B shows the stop element pushing the top of the reset element forward.

Figure 10:
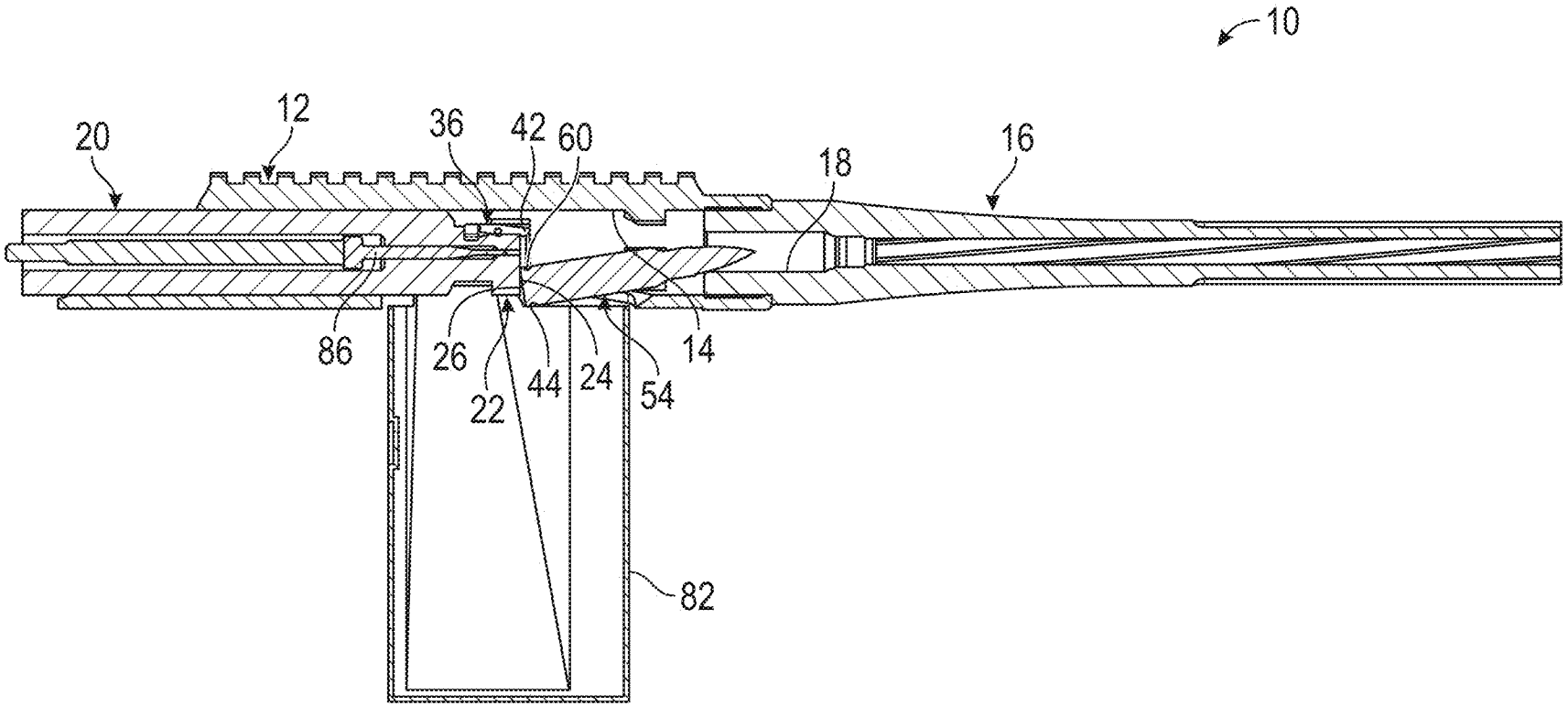
FIG. 10 is a side sectional view of the bolt action firearm of FIG. 1 halfway feeding a cartridge from a magazine into the chamber of a barrel.

FIG. 10 illustrates the improved bolt action firearm 10 of the present invention. More particularly, the bolt action firearm is shown with a cartridge 54 starting to be fed into the chamber 18. The actuator 36 is in the first position because the cartridge has not yet encountered the front end of the actuator. As a result, the linkage 38 has lifted the ejector restraint element 34 to engage the notch 50 in the ejector element 32 to hold the ejector element back below the bolt face 24.

Figure 11:
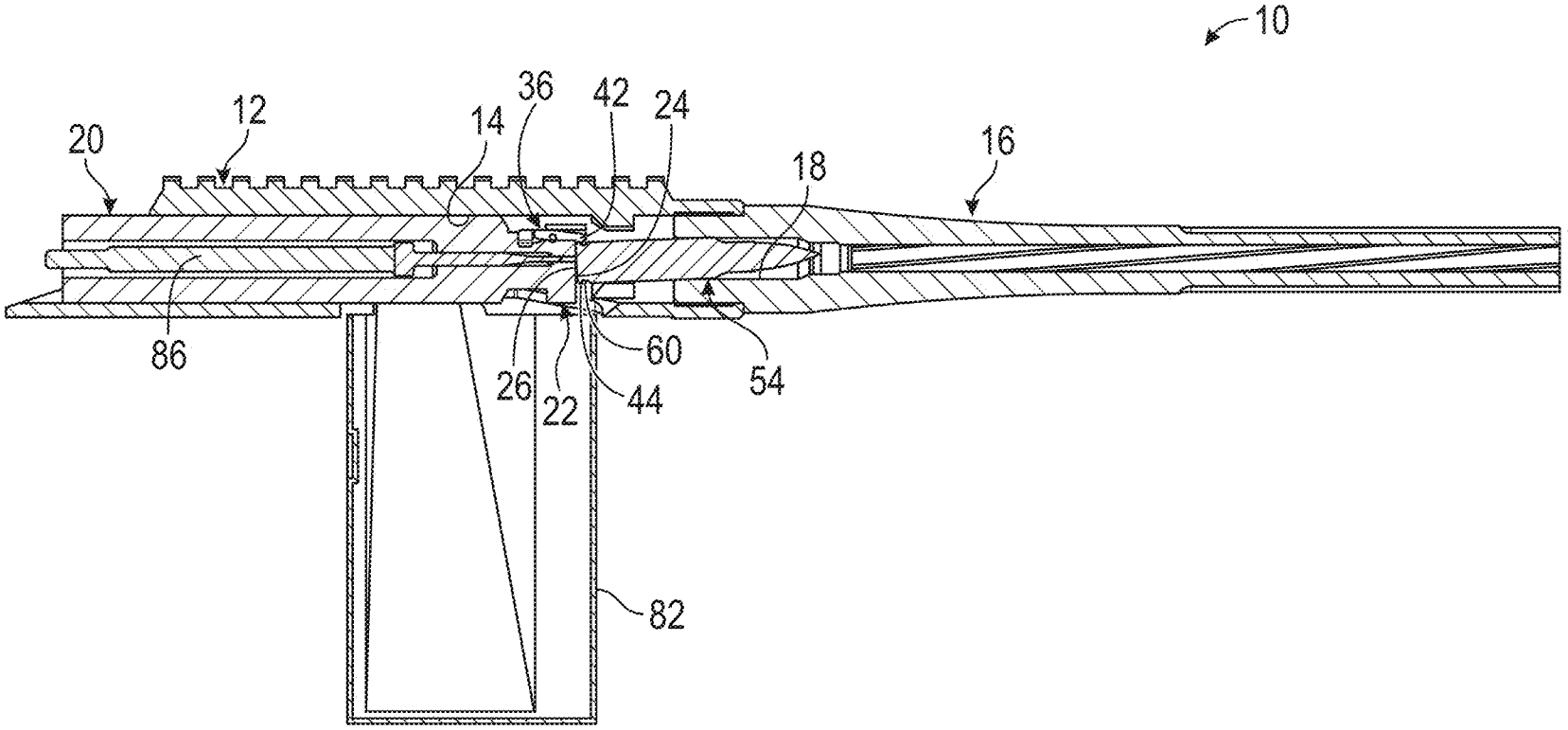
FIG. 11 is a side sectional view of the bolt action firearm of FIG. 1 having fed a cartridge further into the chamber of a barrel.

FIG. 11 illustrates the improved bolt action firearm 10 of the present invention. More particularly, the bolt action firearm is shown with a cartridge 54 having been fed further into the chamber 18. The actuator 36 remains in the first position because the cartridge has not yet encountered the front end of the actuator, although the cartridge case head 26 is on the verge of doing so. As a result, the linkage 38 has lifted the ejector restraint element 34 to engage the notch 50 in the ejector element 32 to hold the ejector element back below the bolt face 24.

Figure 12:
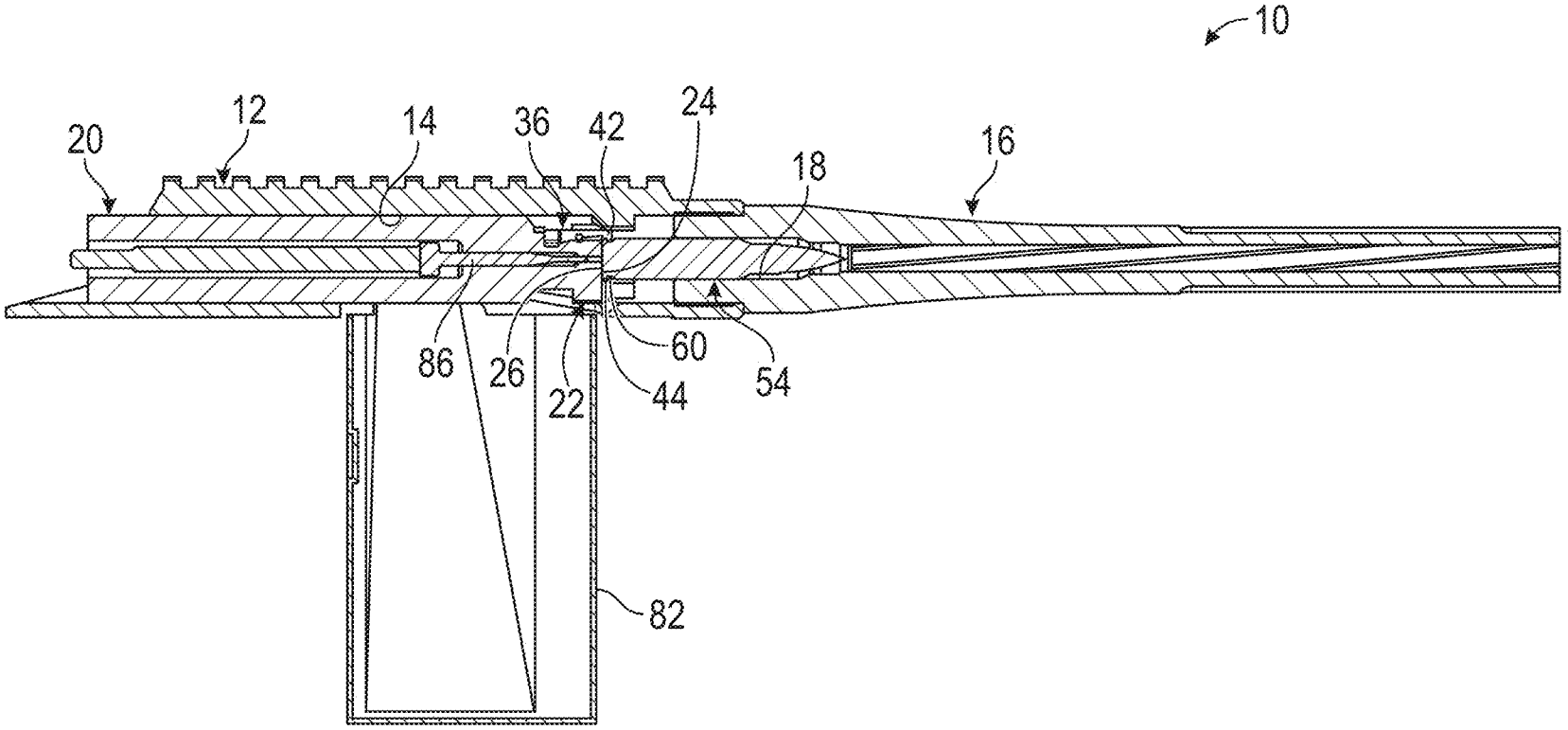
FIG. 12 is a side sectional view of the bolt action firearm of FIG. 1 having fed a cartridge further into the chamber of a barrel with the actuator having transitioned to the second position.

FIG. 12 illustrates the improved bolt action firearm 10 of the present invention. More particularly, the bolt action firearm is shown with a cartridge 54 further fed into the chamber 18. The actuator 36 has transitioned to the second position because the cartridge case head 26 has raised the front end of the actuator. As a result, the linkage 38 has lowered the ejector restraint element 34 below the notch 50 in the ejector element. This disengagement enables the ejector element to go forward under spring pressure exerted by spring 64. Although the forward end face 40 of the ejector element hits the cartridge case head, the cartridge is contained by the chamber of the barrel 16, so the cartridge does not move.

Figure 13:
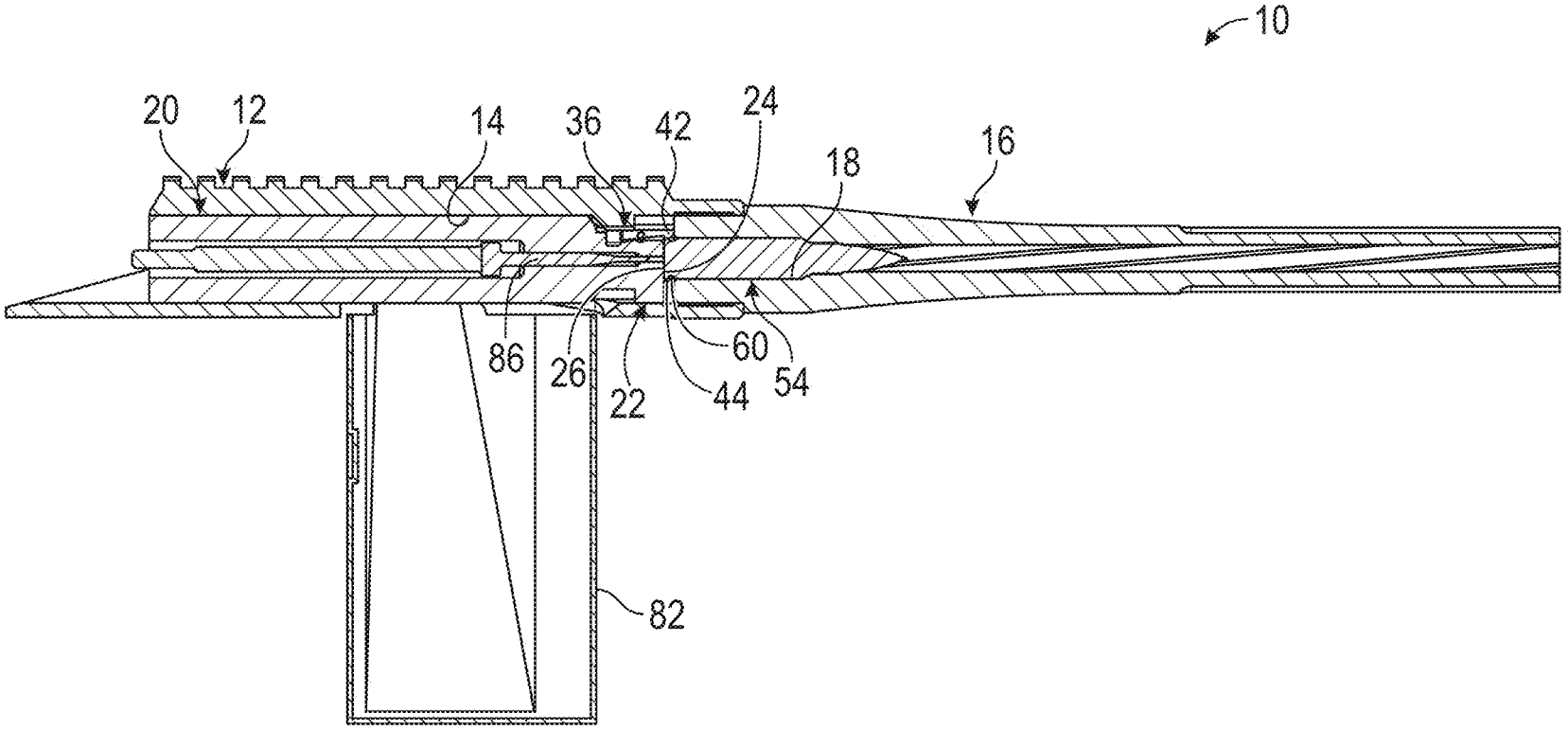
FIG. 13 is a side sectional view of the bolt action firearm of FIG. 1 having fed a cartridge fully into the chamber of a barrel. The bolt assembly is unlocked.

FIG. 13 illustrates the improved bolt action firearm 10 of the present invention. More particularly, the bolt action firearm is shown with a cartridge 54 fully fed into the chamber 18. The bolt assembly 20 is all the way forward, but the lugs 84 on the bolt head 22 have not yet rotated to lock into the receiver 12.

Figure 14:
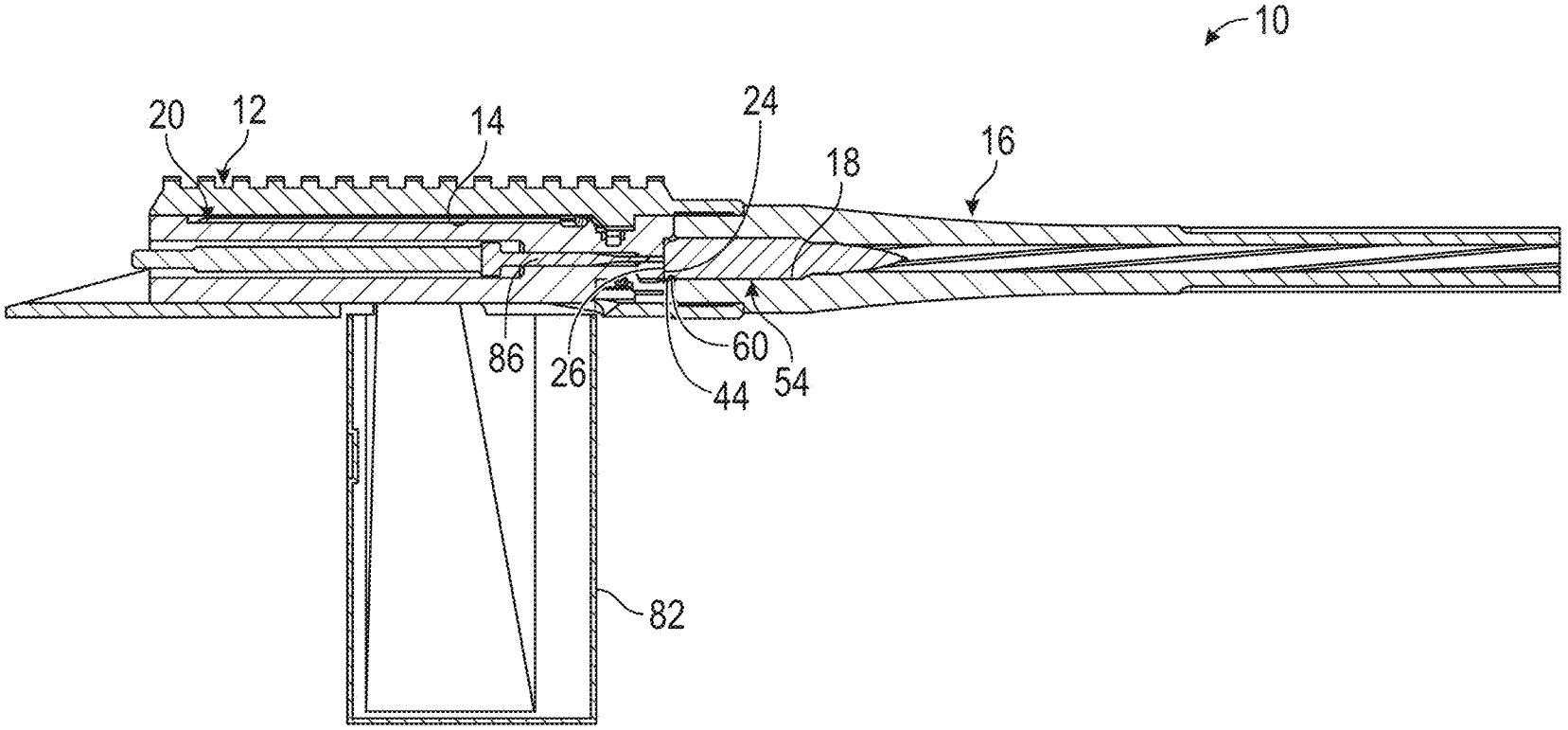
FIG. 14 is a side sectional view of the bolt action firearm of FIG. 1 having fed a cartridge fully into the chamber of a barrel. The bolt assembly is locked, making the bolt action firearm ready to fire.

FIG. 14 illustrates the improved bolt action firearm 10 of the present invention. More particularly, the bolt action firearm is shown with a cartridge 54 fully fed into the chamber 18. The bolt assembly 20 is all the way forward, and the lugs 84 on the bolt head 22 have rotated to lock into the receiver 12. The bolt action firearm is ready to fire.

Figure 15:
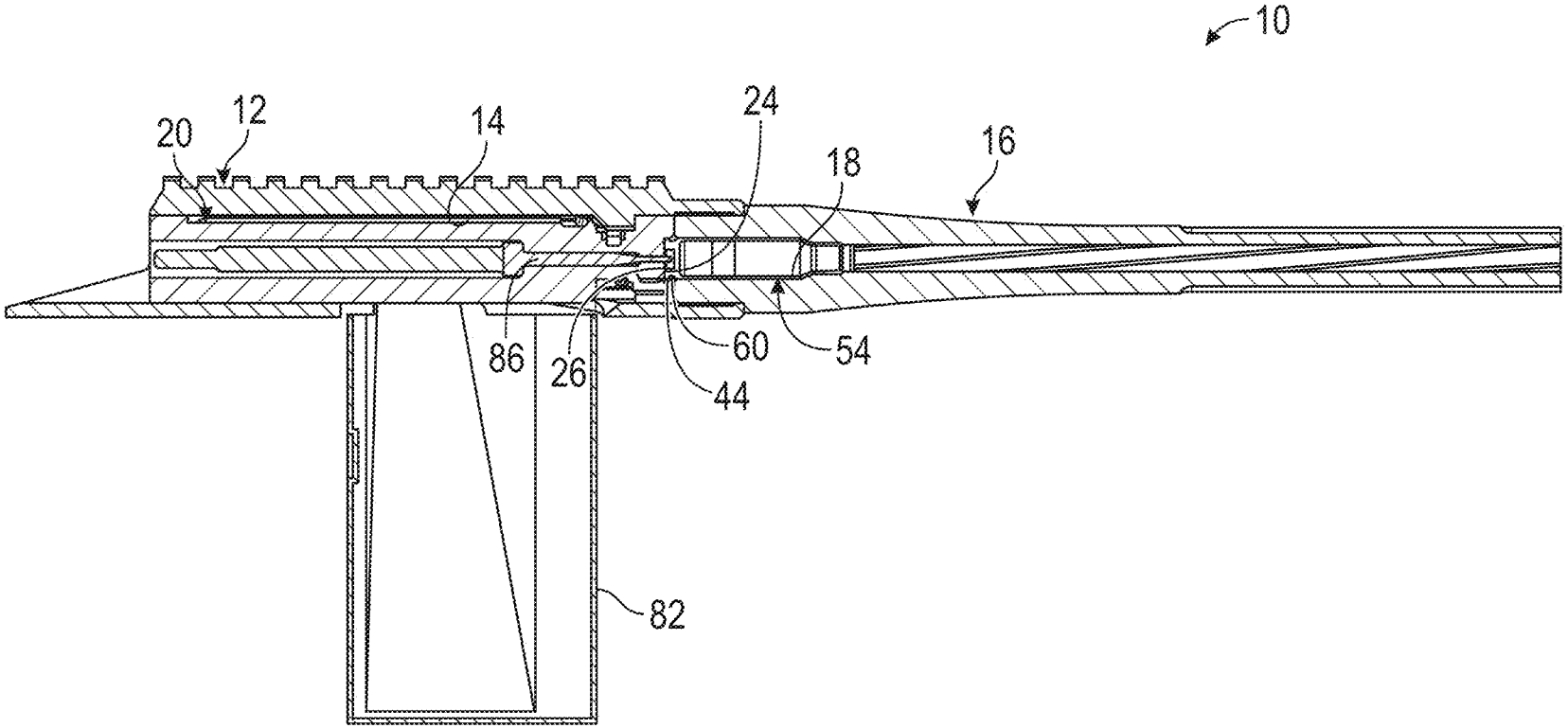
FIG. 15 is a side sectional view of the bolt action firearm of FIG. 1 with a discharged cartridge in the chamber of a barrel. The bolt action firearm has fired, and the bolt assembly is locked.

FIG. 15 illustrates the improved bolt action firearm 10 of the present invention. More particularly, the bolt action firearm is shown with a discharged cartridge 54 fully inserted into the chamber 18. The bolt assembly 20 is all the way forward, and the lugs 84 on the bolt head 22 have rotated to lock into the receiver 12. The firing pin 86 has been released, and the cartridge of the bolt action firearm has fired.

Figure 16:
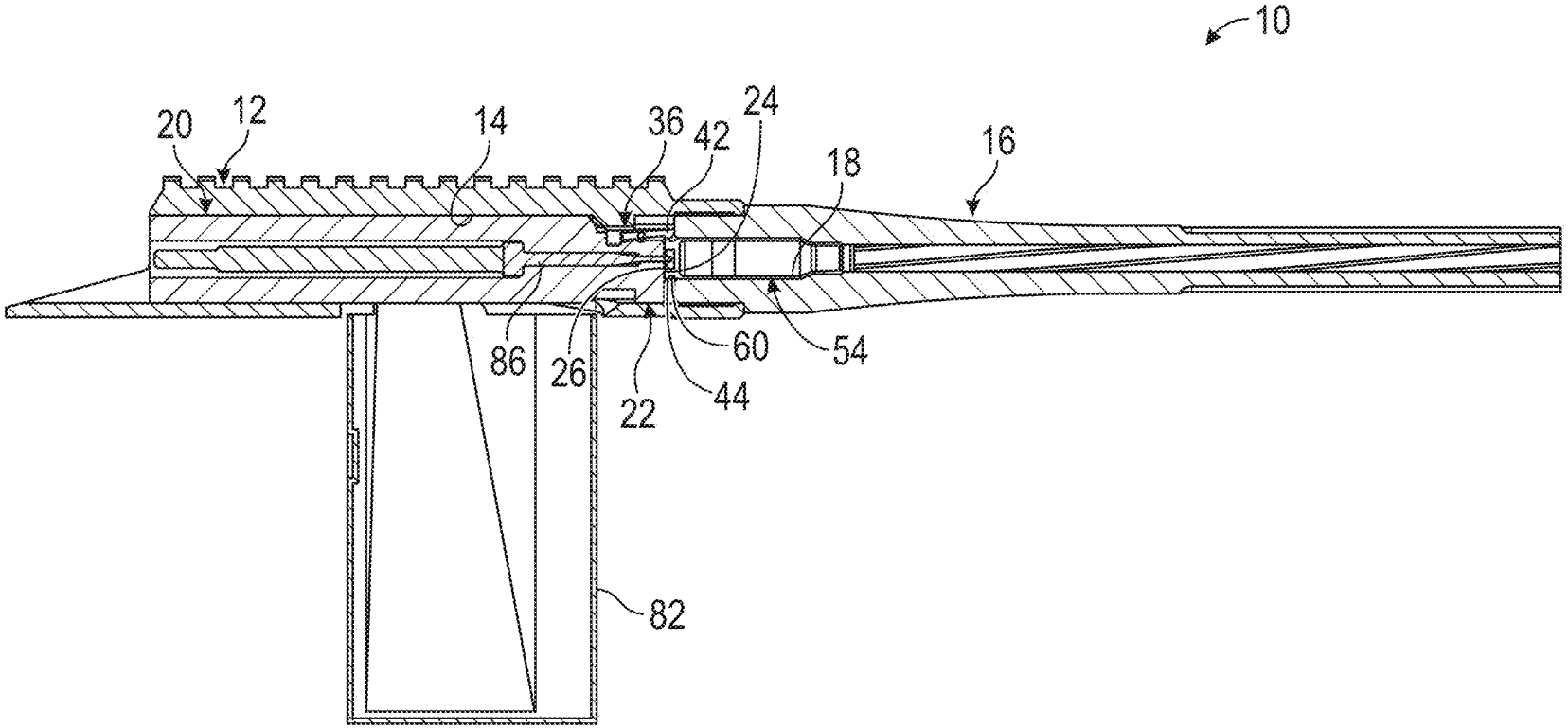
FIG. 16 is a side sectional view of the bolt action firearm of FIG. 1 with a discharged cartridge in the chamber of a barrel. The bolt assembly has unlocked.

FIG. 16 illustrates the improved bolt action firearm 10 of the present invention. More particularly, the bolt action firearm is shown with a discharged cartridge 54 fully inserted into the chamber 18. The bolt assembly 20 is all the way forward, and the lugs 84 on the bolt head 22 have unlocked from the receiver 12.

Figure 17:
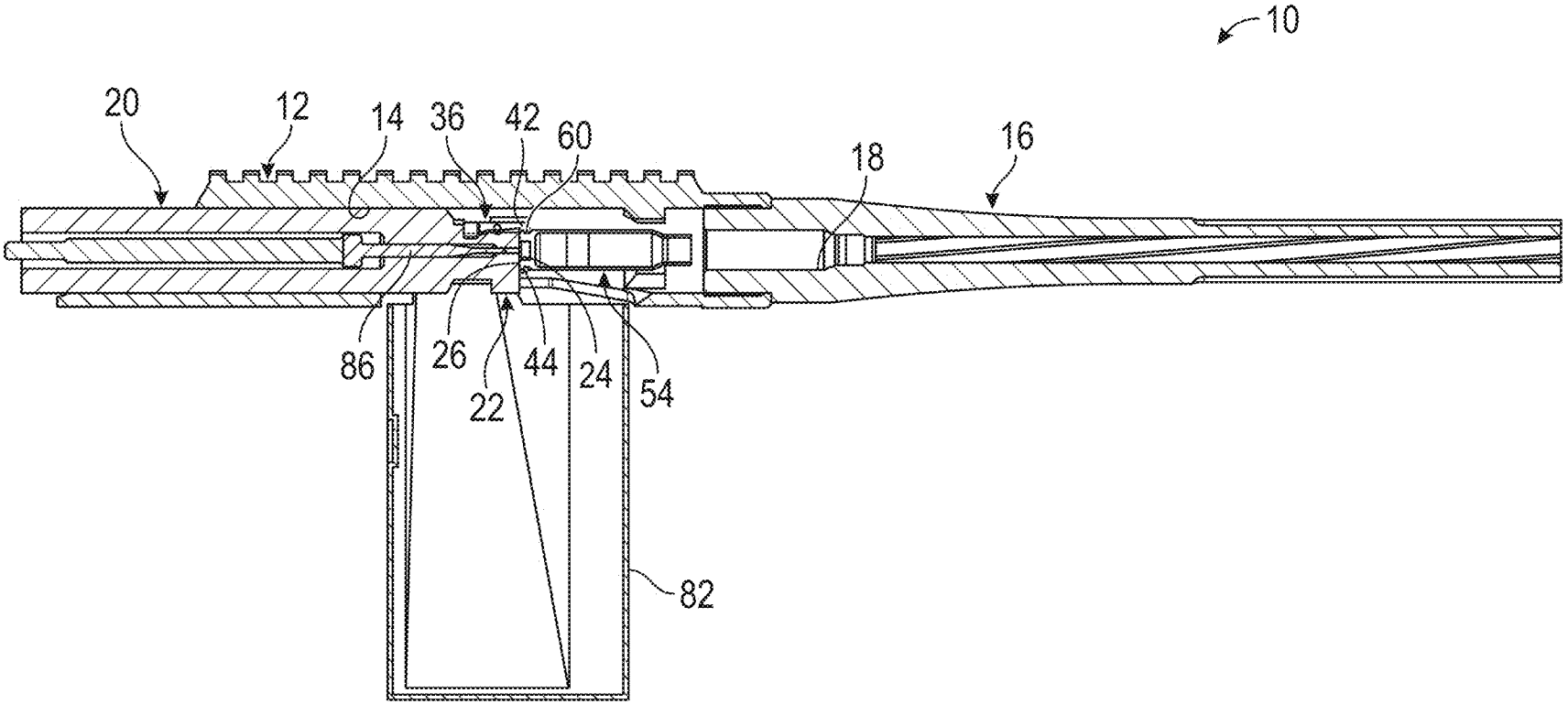
FIG. 17 is a side sectional view of the bolt action firearm of FIG. 1 with the bolt assembly retracted halfway. The discharged cartridge has been extracted from the chamber.

FIG. 17 illustrates the improved bolt action firearm 10 of the present invention. More particularly, the bolt action firearm is shown with the bolt assembly 20 having been pulled halfway through its stroke and having extracted the discharged cartridge 54 from the chamber 18. The ejector element 32 has started pushing the discharged cartridge forward on one side, and the extractor element 56 is holding the case rim 44 on the other side, creating a moment. The discharged cartridge has started to rotate, but is not yet far enough back to be flung out of the ejection port 88 of the receiver 12.

Figure 18:
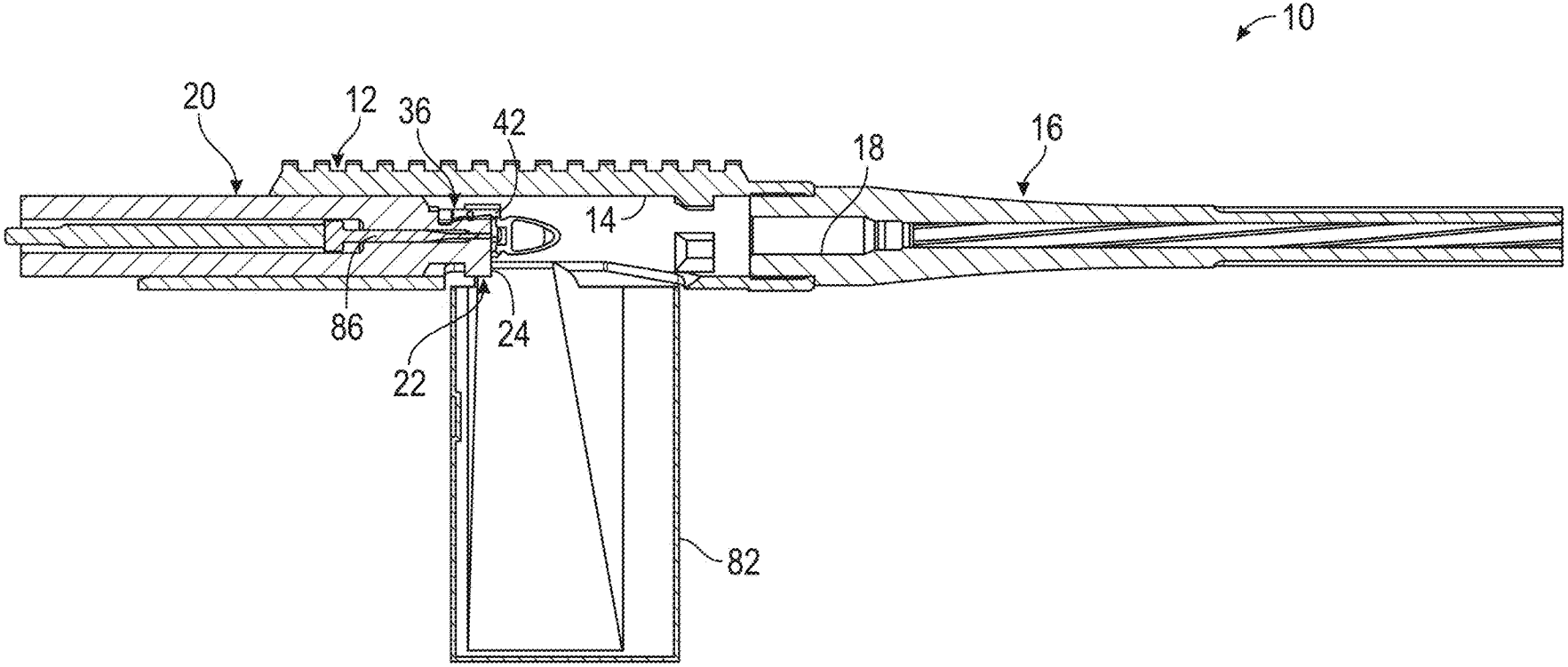
FIG. 18 is a side sectional view of the bolt action firearm of FIG. 1 with the bolt assembly having retracted sufficiently to fling the discharged cartridge out of the ejection port of the receiver.

FIG. 18 illustrates the improved bolt action firearm 10 of the present invention. More particularly, the bolt action firearm is shown with the bolt assembly 20 having been retracted sufficiently to enable the ejector element 32 and the extractor element 56 to fling the discharged cartridge 54 out of the ejection port 88 of the receiver 12. The ejector element is at full extension through the bolt face 24.

Figure 19A:
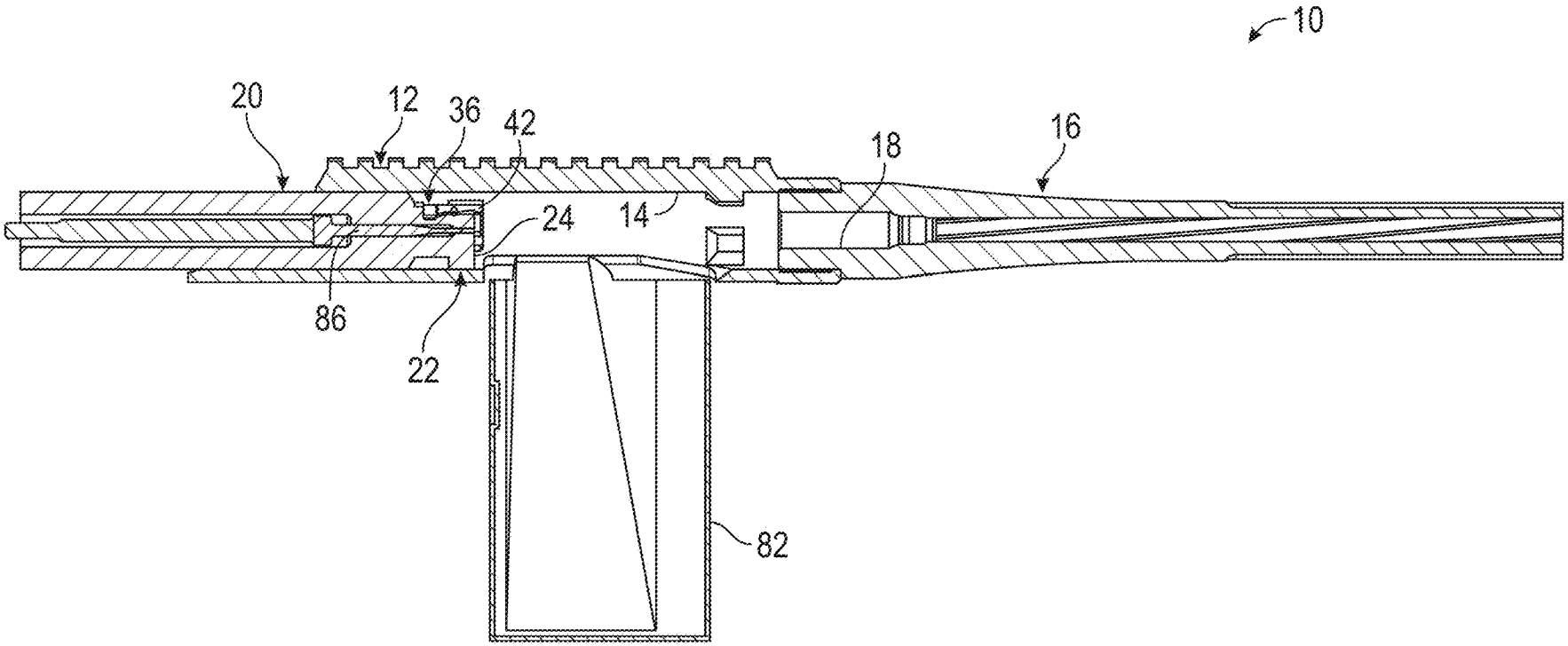
FIG. 19A is a side sectional view of the bolt action firearm of FIG. 1 with the bolt assembly having retracted further within the receiver.
Figure 19B:
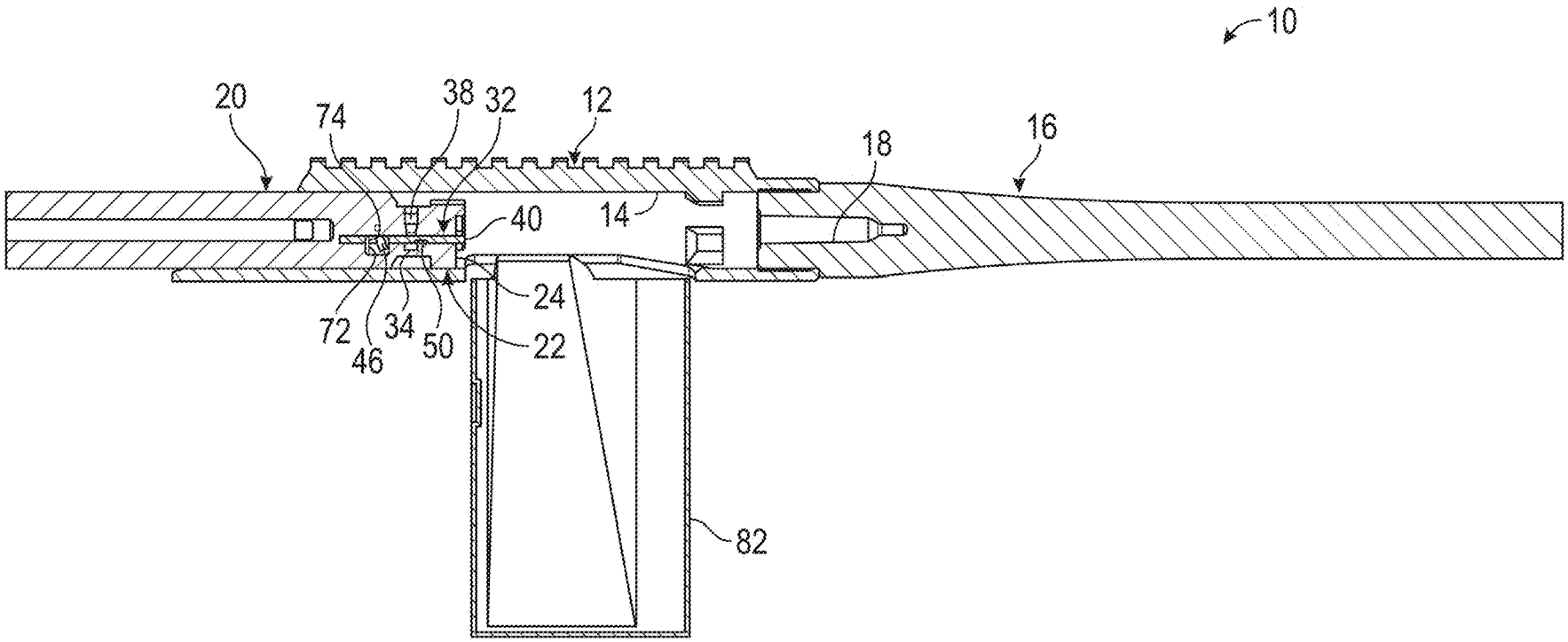
FIG. 19B is a side sectional view of the bolt action firearm of FIG. 1 with the bolt assembly in the same position as FIG. 19A. The ejector element is visible at full extension through the bolt face.

FIGS. 19A & B illustrate the improved bolt action firearm 10 of the present invention. More particularly, the bolt action firearm is shown with the bolt assembly 20 having been retracted further within the receiver 12. The ejector element 32 remains at full extension through the bolt face 24.

Figure 20A:
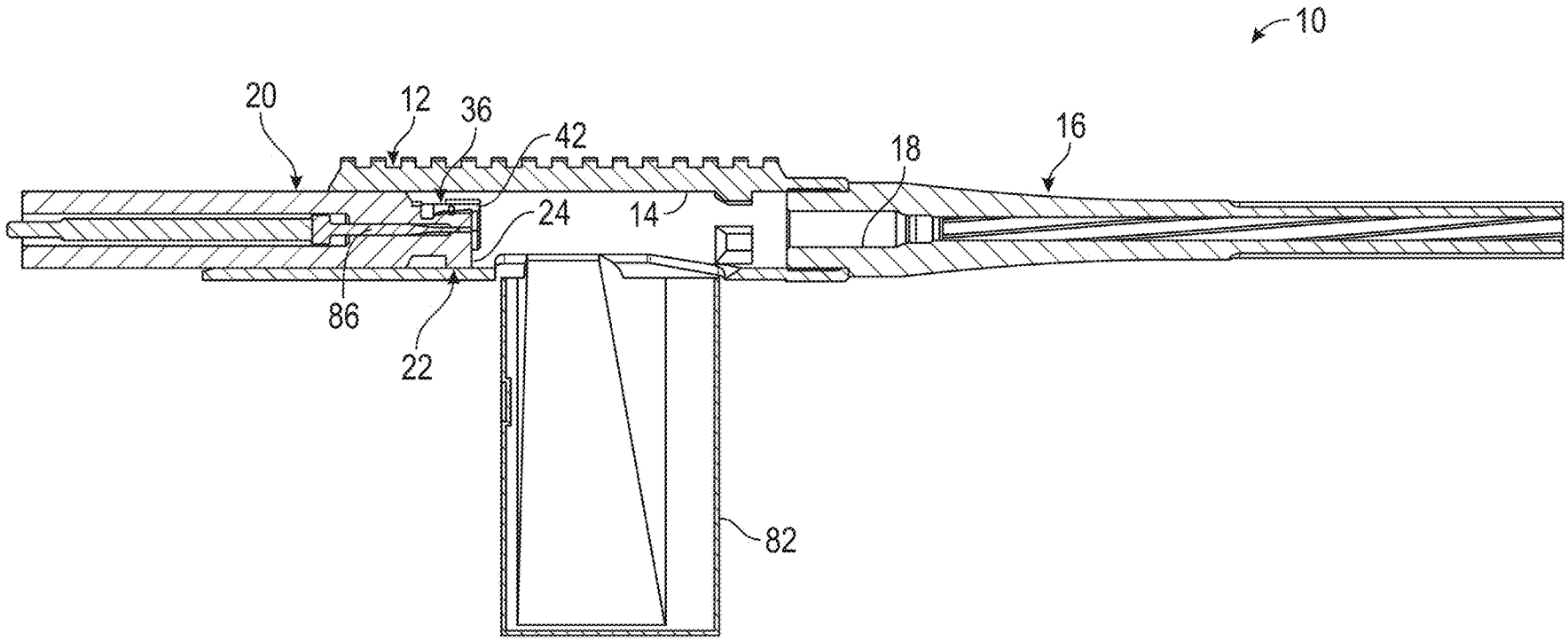
FIG. 20A is a side sectional view of the bolt action firearm of FIG. 1 with the bolt assembly having retracted to the further extent within the receiver. The stop element has pushed the top of the reset element forward to retract the ejector element.
Figure 20B:
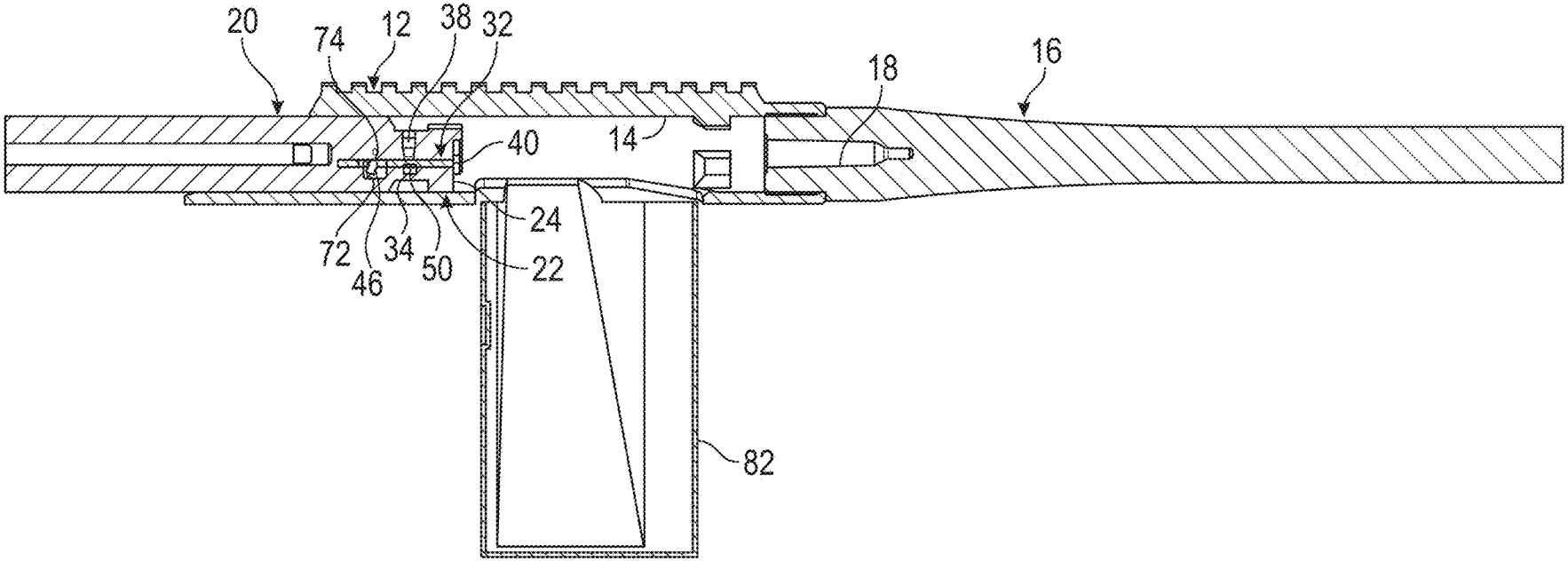
FIG. 20B is a side sectional view of the bolt action firearm of FIG. 1 with the bolt assembly in the same position as FIG. 20A. The ejector element is visible having retracted so the forward end face of the ejector element is below the bolt face.

FIGS. 20A & B illustrate the improved bolt action firearm 10 of the present invention. More particularly, the bolt action firearm is shown with the bolt assembly 20 having been retracted to the furthest extent (the fully open position) within the receiver 12. The additional retraction movement has caused the stop element 48 to push the top of the reset element 46 forward. This causes the bottom of the reset element to move rearward, retracting the ejector element 32. The linkage 38 is then lifted up by the spring 70 pushing the rear of the actuator 36 up. The ejector restraint element 34 engages the notch 50 of the ejector element to restrain ejector element so the forward end face 40 is below the bolt face 24.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a bolt action firearm has been described in detail, it should be apparent that modifications and variations thereto are possible, all of which fall within the true spirit and scope of the invention. For example, it should be appreciated that although a bolt action firearm is disclosed, the principles of the invention are also suitable for use with pump action, semi-automatic, lever action, and other types of firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bolt action firearm comprising:

a receiver defining a bolt passage;

a barrel defining a chamber connected to the receiver;

a bolt assembly received in the bolt passage and operable to reciprocate between a forward battery position proximate the barrel and a rearward fully open position;

the bolt assembly including a bolt head having a bolt face configured to abut a cartridge case head and receive the cartridge case head in an aligned position for discharge;

the bolt head defining an ejector bore having an ejector bore aperture in the bolt face;

an ejector element received in the ejector bore and movable between a forward position in which a portion of the ejector element protrudes from the bolt face and a rearward position rear of the forward position;

the ejector element being spring biased to the forward position;

an ejector restraint element movable between a restraining position and a release position and operable in the restraining position to restrain the ejector element to the rearward position, and when in the release position to enable movement of the ejector element from the rearward position to the forward position;

an actuator associated with the bolt face and movable between a first position conflicting with the presence of the cartridge case head in the aligned position, and a second position enabling the cartridge case head in the aligned position, such that seating the cartridge case head in the aligned position motivates the actuator from the first position to the second position; and a linkage connecting the actuator to the ejector restraint element and operable in response to movement of the actuator from the first position to the second position to enable movement of the ejector element from the rearward position to the forward position.

2. The bolt action firearm of claim 1 wherein the ejector element does not protrude from the bolt face when in the rearward position.

3. The bolt action firearm of claim 1 wherein the ejector element has a forward end face when in the rearward position that is in one of a first condition flush with the bolt face and a second condition recessed with respect to the bolt face.

4. The bolt action firearm of claim 1 wherein the actuator is a lever having a forward end positioned forward of the bolt face.

5. The bolt action firearm of claim 1 wherein the actuator is configured for motivating contact by a case rim.

6. The bolt action firearm of claim 1 wherein the actuator is spring biased to the first position.

7. The bolt action firearm of claim 1 including a reset element operably engaging the ejector element and operable in response to movement of the bolt assembly to the fully open position to move the ejector element to the rearward position.

8. The bolt action firearm of claim 7 wherein the receiver includes a stop element configured for contact by the reset element.

9. The bolt action firearm of claim 8 wherein the stop element is a bolt disassembly element operable to enable removal of the bolt assembly from the receiver.

10. The bolt action firearm of claim 7 wherein the reset element is pivotally connected to the bolt assembly.

11. The bolt action firearm of claim 1 wherein the ejector element is an elongated body defining a notch at an intermediate location along the length of the elongated body configured for contact by the linkage.

12. The bolt action firearm of claim 1 wherein the bolt face has a lower portion free of forward protrusions such that the lower portion is operable to strip a cartridge having the cartridge case head and enable the cartridge case head to slide upward along the bolt face to contact an extractor element.

13. The bolt action firearm of claim 1 wherein the bolt face has an upper portion bounded by an extractor element configured to engage a case rim groove and to prevent a cartridge having the cartridge case head from being separated from the bolt face in a forward direction.

14. The bolt action firearm of claim 13 wherein the extractor element bounds a major portion of the upper portion.

* * * * *